United States Patent [19]

Matthias

[11] 4,427,303

[45] Jan. 24, 1984

[54] ELECTRONIC WRISTWATCH

[75] Inventor: Jan H. Matthias, Beverly Hills, Calif.

[73] Assignee: Hermann Hirsch Leder und Kunstoffwarenfabrik, A-Klagenfurt, Austria

[21] Appl. No.: 389,426

[22] Filed: Jun. 17, 1982

[51] Int. Cl.[3] ..... G04B 37/00

[52] U.S. Cl. ..... 368/282

[58] Field of Search ..... 368/88, 155, 156, 276–278, 368/281, 282, 291, 313

[56] References Cited

U.S. PATENT DOCUMENTS

| | | | |
|---|---|---|---|
| 3,971,207 | 7/1976 | Murakami et al. | 368/282 X |
| 3,977,176 | 8/1976 | Murakami et al. | 368/282 X |
| 4,194,355 | 3/1980 | Nishida | 368/282 |
| 4,255,801 | 3/1981 | Ode et al. | 368/313 |

*Primary Examiner*—Vit W. Miska

*Attorney, Agent, or Firm*—Spensley, Horn, Jubas & Lubitz

[57] ABSTRACT

An electronic device having a plurality of separate modules worn on a wrist band is provided wherein the modules may be variably placed on the wrist band electrically interconnecting the modules.

3 Claims, 6 Drawing Figures

ELECTRONIC WRISTWATCH

BACKGROUND OF THE INVENTION

1. Field of the Invention

The present invention relates to electronic devices worn on the wrist, and more particularly, to such devices having separate electronic components.

2. Description of the Prior Art

Electronic devices such as clocks and even calculators have become sufficiently compact and light-weight to be worn on the wrist. These devices typically have a control circuit which performs the time-keeping (or calculating) functions. A second major component of the device is the display circuit which provides the output (e.g., the time-of-day) of the control circuitry in a form readable by the human user. These display circuits typically utilize LCD's (liquid crystal displays) or LED's (light emitting diodes) to form the alphanumeric characters. A third major component is the power source, usually a battery, which provides the electrical energy to power the control circuitry and display.

The display circuit, control circuit and battery have usually been housed into a single module since these components must be electrically coupled together. As a result, the watch or calculator module which is attached to a wrist band, tends to be rather bulky and top heavy, particularly where the housing is made of metal.

In order to reduce the size of the module, an alternative approach has been taken in which the control circuitry (and/or battery) have been housed in a separate module typically worn on the other side of the wrist. Consequently, this has necessitated an electrical connection through the wrist band between the various modules attached to the wrist band.

One approach for accomplishing such an electrical connection between modules is suggested in U.S. Pat. No. 4,194,355 to Nishida. There, electrical connector wires embedded in the wrist band each have an individual terminal at the end of the wrist band. These wrist band terminals form a plug which mates with electrical connectors of a display module. Although the connector scheme suggested in this reference allows the electronic components of the device to be distributed into two modules, the interconnection between the wrist band and the display module is somewhat complicated and therefore relatively expensive to manufacture.

Furthermore, the length of the wrist band between the display module and the other module is fixed once the terminal plug is attached to the end of the wrist band at the factory. As a result, the length of the wrist band between the display module and the separate electronics module cannot be easily adjusted to accommodate various wrist sizes.

SUMMARY OF THE INVENTION

It is an object of the present invention to provide an improved wrist-worn electronic device having a display module which may be variably placed on a wrist band which interconnects the display module with a separate electronics module.

It is another object of the present invention to provide an electronic device having a display module and a separate electronics module interconnected by a wrist band which may be conveniently cut to a desired length.

These and other objects and advantages are achieved in an electronic device which has a display module and a separate electronics module which are interconnected by a flexible wrist band. The wrist band has a plurality of connector wires embedded in the wrist band for electrically coupling the display module to the electronics module. An insulator material of the wrist band encases the connector wires in a spaced relationship.

In accordance with the present invention, the display module has a plurality of spaced connector pins which are adapted to be driven into the wrist band to pierce the insulator material. The connector pins are positioned to make electrical contact with the connector wires of the wrist band completing the electrical circuits between the display module and the separate electronics module. In this manner, the display module may be placed anywhere along the wrist band.

DETAIL DESCRIPTION OF THE DRAWINGS

Figure 1:
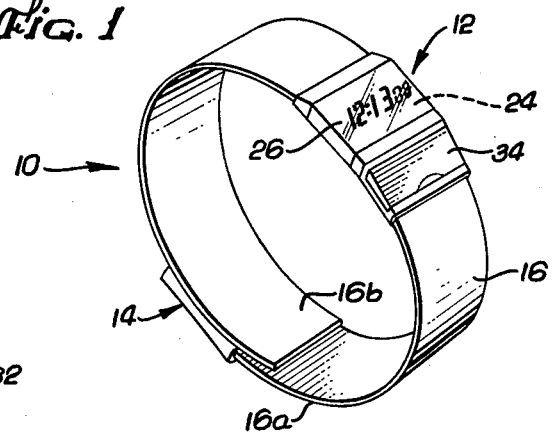
FIG. 1 is a pictorial view of a wrist watch in accordance with the present invention.

Referring now to FIG. 1, a wrist watch in accordance with the present invention is indicated generally at 10. The wrist watch 10 has a display module 12 and a separate electronics module 14, both of which are attached to a wrist band 16 worn about the wrist. The wrist band 16 has a plurality of uniformly spaced connector wires 18 (FIG. 3) embedded in a flexible insulator material 20.

The display module 12 has a generally rectangular housing 21 which includes a clear face portion 22. Beneath the face portion 22, a display circuit 24 is placed which can present numerical characters such as those indicated that 26. Although the illustrated embodiment is a wrist watch, the present invention is equally applicable to other electronic devices worn on a wrist band such as calculators, for example.

The separate electronics module 14 contains time-keeping circuitry (not shown) which is typically in the form of one or more integrated circuits. Powering the electronics module 14 (and also the display circuit 24) is a battery (also not shown) contained within electronics module 14. The connector wires 18 of the wrist band 16 are electrically connected to the output terminals of the circuitry of the module 14 in a conventional manner. However, as will be more clear in the following description, the display module 12 may, in accordance with the present invention, be easily placed anywhere along the wrist band 16.

Figure 2:
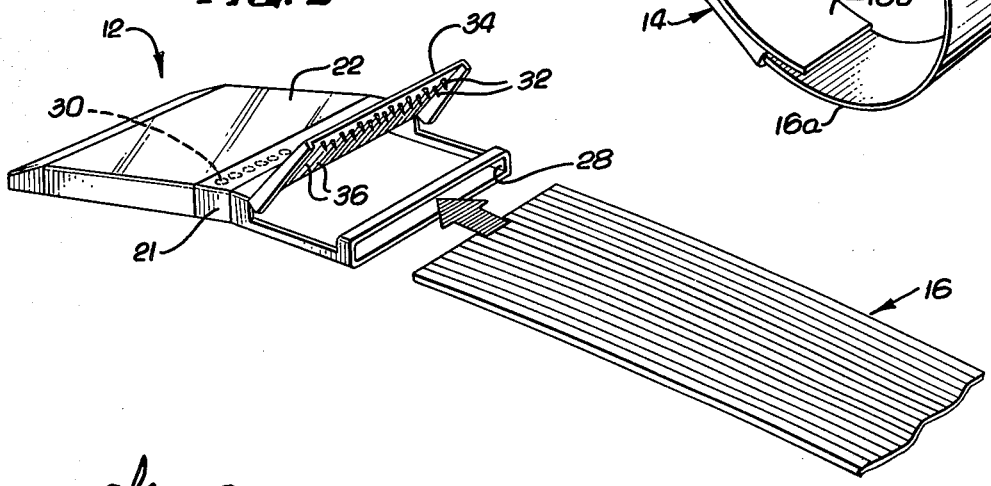
FIG. 2 is a pictorial view of the display module of FIG. 1, illustrating the insertion of the wrist band into the display module.

In order to place the display module 12 on the wrist band 16, the display module 12 has a channel 28 (FIG. 2) passing the entire length of the display module 12 through which the wrist band 16 may be inserted.

Within the housing 21 of the display module 12 are a plurality of output terminals of the display circuit 24, which are indicated in broken line at 30.

In order to electrically connect the output terminals 30 of the display module 12 to the connector wires 18 of the wrist band 16, the display module 12 has a plurality of sharply pointed connector pins 32 carried on a hinged cover 34. Each connector pin 32 is connected by a wire 36 to an output terminal 30 of the display circuit 24. The connector pins 32 are arranged in two rows and are spaced to register with the connector wires 18 of the wrist band 16 when placed in the channel 28. When the display module 12 is placed at the desired location along the wrist band 16, the cover 34 may be closed driving the connector pins 32 into the wrist band 16.

Figure 3:
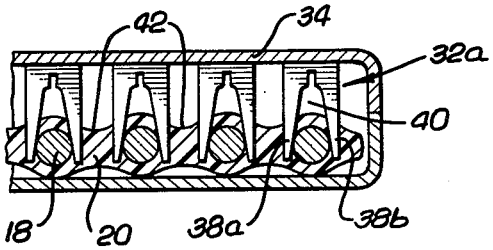
FIG. 3 is a cross-sectional view illustrating the connection of the display module connector pins to the connector wires of the wrist band.
Figure 4:
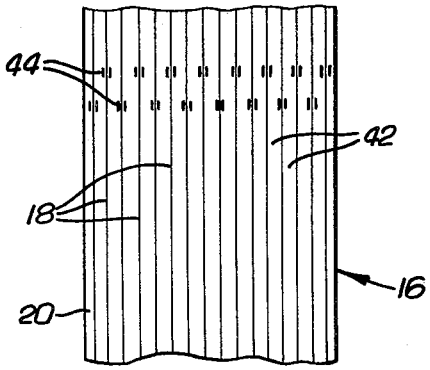
FIG. 4 is an elevational view of a portion of the wrist band of FIG. 1 illustrating the placement of the connector pins of the display module of FIG. 1.
Figure 6:
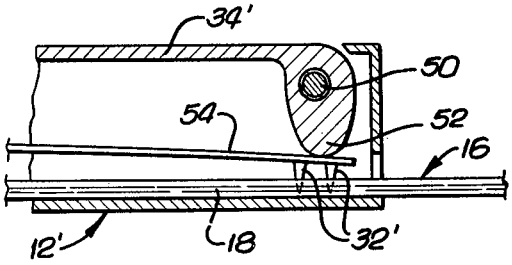
FIG. 6 illustrates the display module cover of FIG. 5 in the closed position.

The coupling of the connector pins 32 to the connector wires 18 of the wrist band 16 is shown in greater detail in FIG. 3. A representative connector pin indicated at **32*a* has two sharply pointed portions 38*a* and 38*b* which are shaped to pierce the insulator material 20 of the wrist band 16 as the cover 34 is closed. The connector pin portions 38*a* and 38*b* define a slot 40 which engages the corresponding connector wire 18*a* as the connector pin 32*a* is driven down into the wrist band 16. The insulating material 20 has an area of reduced thickness 42 between each of the connecting wires 18 to facilitate the coupling of each connector pin 32 with the appropriate connector wire 18. FIG. 4 illustrates the pattern in which the connector pins 32 (as represented by the dots 44) engage the connector wires 18 of the wrist band 16**.

In this manner, electrical connections are made between the connector wires 18 and the output terminals 30 of the display circuit 24. Thus, it is seen that the display module 12 may be placed at any desired location along the wrist band 16 merely by sliding the display module 12 to the desired location and closing the cover 34, piercing the wrist band 16, and thereby making electrical contact. In addition, the connector pins 32 serve to fix the display module 12 to the wrist band 16 preventing movement of the display module 12 relative to the wrist band 16.

The wrist watch 10 is now fully functional with the display module 12 completely coupled to the separate electronics module 14 through the wrist band 16, as shown in FIG. 1. The wrist watch 10 may be worn on the user's wrist by attaching the wrist band portion **16*a* of the wrist band 16 to the outside of the free end 16*b* of the wrist band by means of velcro or other clasp mechanisms. It is seen from FIG. 1, that the display module 12 can be placed on the wrist band 16 such that the display module 12 is always on the opposite side of the wrist from the electronics module 14 regardless of the particular user's wrist size. This is usually desirable in that it gives the wrist watch a symmetrical appearance and a balanced feel. Any excess length at the end 16*b* of the wrist band 16** may cut off without impairing the electrical connection.

The display module 12 can also be shifted to another location simply by lifting the cover 34, which disengages the connector pins 32 from the wrist band 16. After sliding the module 12 to the new location, the cover 34 is again closed coupling the connector pins to the connector wires.

Figure 5:
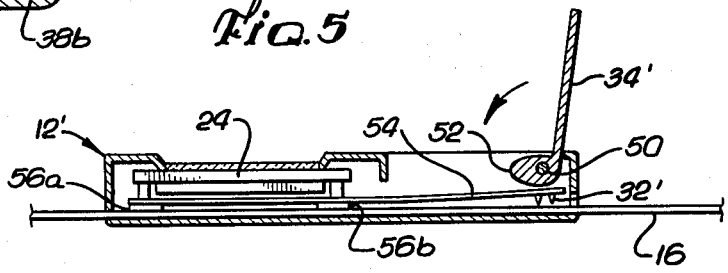
FIG. 5 is a cross-sectional view of an alternative embodiment of the display module of FIG. 1.

An alternative embodiment of the display module 12 of FIG. 1 is indicated generally at 12' in FIG. 5. The display module 12' has a hinged cover 34' which is pivotally mounted to the display module 12' by means of a pin 50. At the pivotal end, the cover 34' has a camming surface 52 which engages a flexible tongue portion 54. The tongue portion 54 has a plurality of connector pins 32' which are similar to the connector pins 32 of FIG. 2. The tongue portion 54 is fixed at its other end to two leg supports **56*a* and 56*b* of the display circuit 24**.

The connector pins 32' are connected by connector wires (not shown) to output terminals of the display circuit 24. The cover 34' functions as a lever to give increased mechanical advantage. As the cover 34' is closed, the camming surface 52 engages the tongue portion 54 driving the connector pins 32' into the connector wires 18 making electrical contact as described above for the previous embodiment.

It will, of course, be understood that modifications of the present invention, and its various aspects, will be apparent to those skilled in the art, some being apparent only after study and others being merely matters of routine mechanical and electrical design. Other embodiments are also possible, with their specific designs dependent upon the particular application. As such, the scope of the invention should not be limited by the particular embodiments herein described, but should be defined only by the appended claims and the equivalents thereof.

I claim:

1. An electronic device to be worn on a user's wrist, comprising:

a flexible wrist band having a plurality of connector wires and an insulator material encasing the wires;

a first electronics module electrically coupled to the connector wires of the wrist band; and a second electronics module having a plurality of connector pins for piercing the insulator material at a desired location along the wrist band and for making electrical contact between the second electronics module and the connector wires of the wrist band.

2. A wrist watch comprising:

an electronics module having a plurality of output terminals;

a wrist band attached to the electronics module and having a plurality of connector wires electrically coupled to the electronics module output terminals, and the wrist band further having insulator material encasing the connector wires; and a display module having a plurality of input terminals, a plurality of connector pins, each of which is electrically coupled to an input terminal, and driving means actuable by a user, for driving the connector pins into a selected portion of the wrist band insulator material to pierce the material and to make an electrical contact between the connector pins and individual connector wires thereby electrically connecting electronic module output terminals to display module input terminals through the wrist band connector wires.

3. The wrist watch of claim 2 wherein the display module driving means includes a flexible tongue portion on which the connector pins are carried and a camming surface for engaging the tongue portion to drive the connector pins into the insulator material.

* * * * *